US005248165A

United States Patent [19]

Lanzarin

[11] Patent Number: 5,248,165

[45] Date of Patent: Sep. 28, 1993

[54] SAFETY DEVICE TO HOLD THE EXTRACTABLE PINS USED FOR HOOKING PAMPHLETS, BROCHURES AND THE LIKE WITHIN A COLLECTING CONTAINER

[75] Inventor: Giuseppe Lanzarin, Vicenza, Italy

[73] Assignee: Cartotecnica Montebello S.r.l., Sarego, Italy

[21] Appl. No.: 893,163

[22] Filed: Jun. 3, 1992

[30] Foreign Application Priority Data

Jun. 11, 1991 [IT] Italy ..... VI91U000060

[51] Int. Cl.[5] ..... B42D 3/00

[52] U.S. Cl. ..... 281/46; 281/45; 206/472; 206/473

[58] Field of Search ..... 206/232, 425, 470, 472, 206/473, 483; 281/28, 21.1, 45, 46; 402/500, 502

[56] References Cited

U.S. PATENT DOCUMENTS

| | | | |
|---|---|---|---|
| 2,274,993 | 3/1952 | Pearl | 281/46 |
| 3,262,454 | 7/1966 | Schillinger | 206/472 |
| 3,338,409 | 8/1967 | Koellisch | 206/472 |
| 4,591,187 | 5/1986 | Jeanson et al. | 281/46 |
| 4,620,724 | 11/1986 | Abildgaard et al. | 281/21.1 |
| 4,652,013 | 3/1987 | Azzato | 281/46 |
| 4,659,109 | 4/1987 | Donovan | 281/46 |
| 4,793,508 | 12/1988 | Thompson | 206/425 |
| 4,997,208 | 3/1991 | Staats | 281/21.1 |
| 5,040,216 | 8/1991 | Policht | 281/46 |
| 5,102,167 | 4/1992 | Groswith | 281/28 |

FOREIGN PATENT DOCUMENTS

| | | | |
|---|---|---|---|
| 536028 | 3/1955 | Belgium | 281/46 |

*Primary Examiner*—David T. Fidei
*Attorney, Agent, or Firm*—Bucknam and Archer

[57] ABSTRACT

A safety device has two plastic elements (2,3) which are applied to the internal surface of the rib of a container (1) to hold brochures, pamphlets and the like. Each element also is provided with a predetermined number of pins (6) which are fixed to the plastic element through a rod (7). The pins may be removed by the user to be inserted within orifices formed in the part of the plastic element (2) of greater thickness and are fixed by rotation of another plate (10), the latter hooking with the base wall (8) and in this manner, the user may determine the number and the distance of the pins to be inserted in the element (2) on the basis of the number and the dimensions of the brochures and pamphlets to be collected.

4 Claims, 2 Drawing Sheets

4
5
6
7
8
9
10
11
12

SAFETY DEVICE TO HOLD THE EXTRACTABLE PINS USED FOR HOOKING PAMPHLETS, BROCHURES AND THE LIKE WITHIN A COLLECTING CONTAINER

FIELD OF THE INVENTION

The present invention relates to a safety device and more specifically to a safety device which permits to hold within a collecting container the extractable pins used for hooking a plurality of brochures, pamphlets and the like.

SUMMARY OF THE INVENTION

According to the invention, the device is made by means of a plastic element which is very simple in construction and of moderate cost and which may be handed in directly to the user and the user may apply it to the collecting containers already in his possession or he may acquire it separately from the collecting container by applying the components in the interior of the brochure or pamphlet by fixing the component parts by means of simple rivets or even screws.

According to the invention, the user himself may provide to remove from the plastic element a predetermined number of the pins and insert the pins within suitable orifices in the plastic element by folding the limb of the element on the head of the element whereby it is possible to block the pins safely, to which pins the brochures or pamphlets must be hooked to be held in the interior of the collecting container.

BRIEF DESCRIPTION OF THE DRAWINGS

The device will be described herein below in more detail by reference to the accompanying drawings of which:

As shown in FIG. 1, numeral 1 designates the interior surface of the container on which are applied two plastic elements 2 and 3 which must be fixed, for instance by means of rivets, by insertion in the orifices 4 and 5 or simply by gluing.

Each one of the two elements 2 and 3 is provided with a predetermined number of pins 6 which are located on the rods 7, the pins being easily removable from the plastic element so that the pins may be inserted within the orifices located in the same plastic element.

Figure 1:
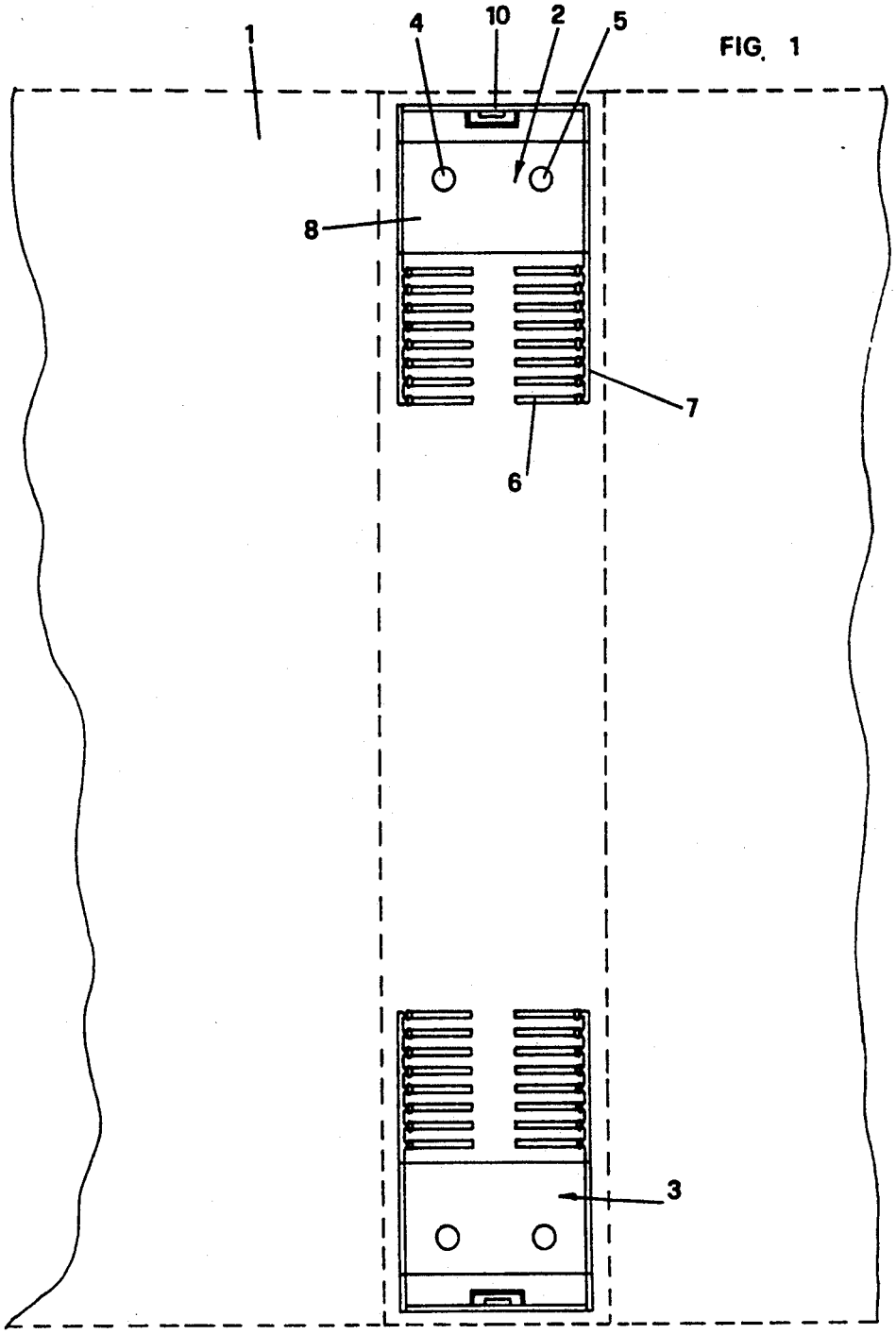
FIG. 1 is a view of the interior of the container on which have already been fixed two plastic elements adaptable to constitute the device for hooking the brochures or pamphlets.
Figures 2, 3, 4, 5:
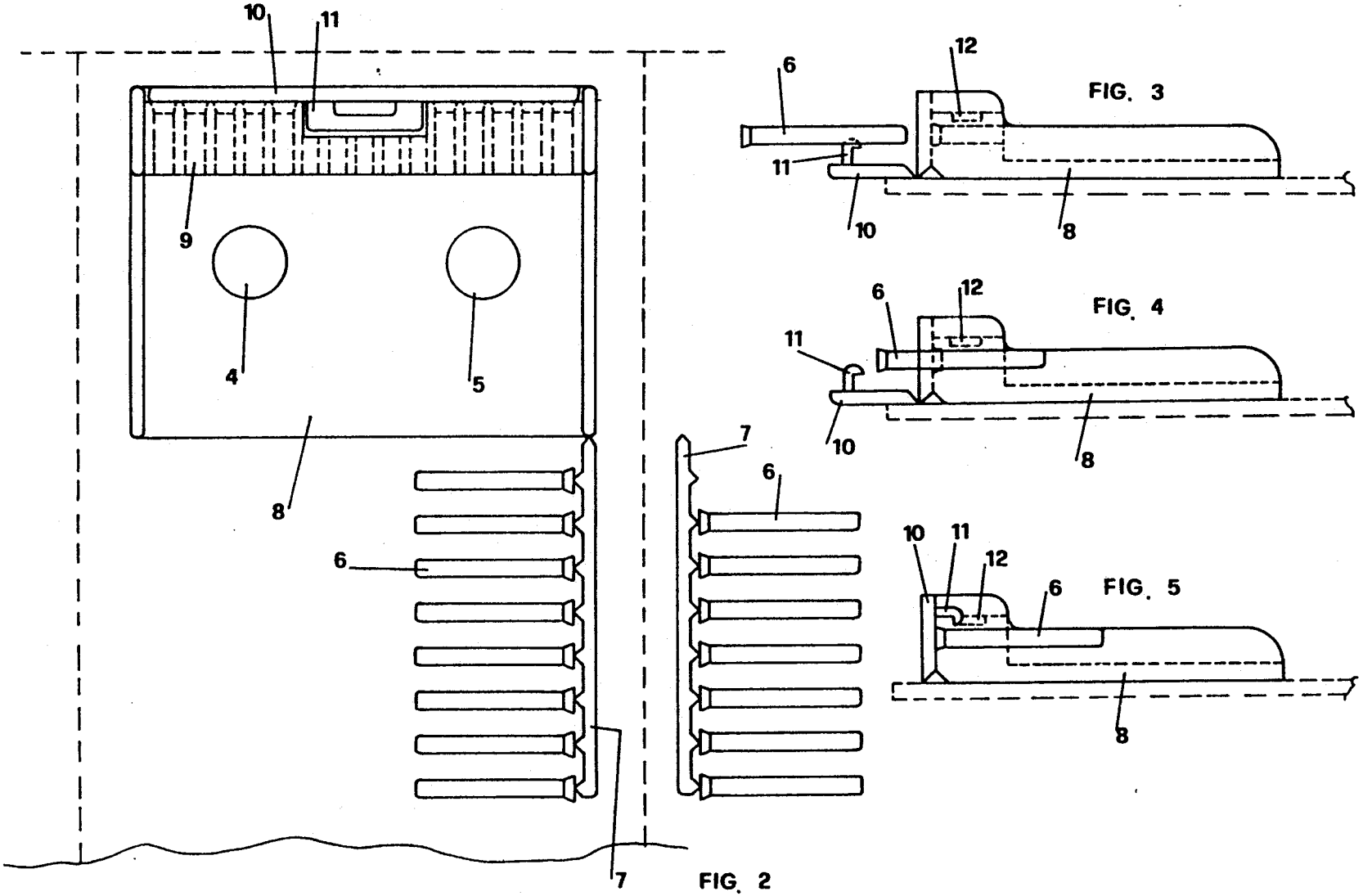
FIG. 2 illustrates on an enlarged scale the plastic element hooked to the container with a part of the pins removed.
FIG. 3 illustrates a side view of the plastic element with one of the pins in the phase of insertion and the head of the plastic element in the open position.
FIG. 4 illustrates the same device as in FIG. 3 with the pin in a position partially inserted.
FIG. 5 illustrates the same device with the pins in a completely inserted position and the plastic wall hooked in a stable closure position.

FIG. 2 shows one of the rods 7 removed from the plastic element. The plastic element comprises a prismatic member which projects from the base wall 8 within which are formed orifices 9 within which the pins 6 are to be inserted. The pins 6 are provided with a head advantageously of a trunco-conical shape which prevents the pins from coming out from the orifices 9 because the pins rest in the cavity which also has a trunco-conical shape which has corresponding dimensions, the cavity being formed on the head of the orifices 9.

Numeral 10 designates a plate fixed to the base of member 8, the plate being folded at an angle of 9 degrees to block the pins inserted into the openings 9 so that any possibility of pins coming out is avoided.

Numeral 11 designates a shaped plate, specifically in the shape of an "L" which is hooked within the notch 12 shown in FIGS. 3 and 4 suitably located in the head of member 8 so as to prevent the pins inserted into the orifices 9 from coming out, the pins having been located in the projecting part of member 8.

The user is capable to insert the pins 6 very easily in the appropriate number and in the desired positions within the orifices 9 previously formed in the projecting part of member 8, as shown in FIG. 4 and is capable to block the position of the pins by causing the plate 10 to rotate up to the point in which the hook 11 engages with the notch 12 as shown in FIG. 5. Clearly the user may select the number of pins 6 and the positions of the pins on the basis of predetermined requirements depending upon the number and volume of the brochures or pamphlets which must be introduced into the collecting container.

The advantages derived from the simplicity of the safety device of the present invention are clear and it is also clear that the device is very economical in production, as well as distribution, and it may be used easily.

What is claimed:

1. The combination of a container intended to collect a plurality of brochures and pamphlets, and a safety device for holding said brochures and pamphlets within said container, said container having a rib, said device being fixed to said rib, said device comprising two plastic elements (2,3), said elements being fixed at opposite ends of said container, each element comprising a base wall (8), said base wall (8) being fixed to the interior surface of said rib of said container, each element having a part projecting from said base wall, orifices (9) located on said part projecting from said base wall, said device including a plurality of rods extending from said elements, said rods severably connected to a number of pins, said pins adapted for insertion into said into said orifices, wherein a user removes a number of pins from at least one of said rods and inserts the pins within said orifices to hold a plurality of brochures and pamphlets.

2. The combination container and safety device according to claim 1, which further comprises a plate fixed to said base wall, said plate foldably secured to rotate about an angle of 90 degrees relative to said base wall, said pins each having a head, said part projecting from said base wall including a notch, a tongue fixed to said plate wherein said tongue is received by said notch upon rotation of said plate, with said plate covering each head of a number of pins, to thereby lock the pins in said orifices.

3. The combination container and safety device according to claim 1, further comprising a pair of apertures in said base wall, each aperture receiving a screw for securing said base wall to the internal surface of said rib of the container.

4. The combination container and safety device according to claim 1 wherein the said base wall (8) is glued to the internal surface of the rib of said container.

* * * * *